US005957176A

United States Patent [19]

Stein

[11] Patent Number: 5,957,176

[45] Date of Patent: Sep. 28, 1999

[54] PROFILED INSERTED-BLADE CUTTER

[75] Inventor: Dieter Stein, Oberkochen, Germany

[73] Assignee: Gebr. Leitz GmbH & Co., Germany

[21] Appl. No.: 08/945,347

[22] PCT Filed: Apr. 25, 1996

[86] PCT No.: PCT/EP96/01720

§ 371 Date: Oct. 24, 1997

§ 102(e) Date: Oct. 24, 1997

[87] PCT Pub. No.: WO96/36452

PCT Pub. Date: Nov. 21, 1996

[30] Foreign Application Priority Data

May 17, 1995 [DE] Germany ..... 295 08 112 U

[51] Int. Cl.[6] ..... B27G 13/00

[52] U.S. Cl. ..... 144/230; 144/218; 144/241; 407/46; 407/47; 241/294

[58] Field of Search ..... 241/191, 195, 241/294; 144/218, 229, 230, 231, 224, 221, 241; 407/40, 42, 46, 47, 49, 51

[56] References Cited

U.S. PATENT DOCUMENTS

| | | | |
|---|---|---|---|
| 1,348,753 | 8/1920 | Shimer | 144/244 |
| 2,874,912 | 2/1959 | Sennholtz et al. | 241/294 |
| 3,146,961 | 9/1964 | Putman, Jr. | 241/191 |
| 3,303,356 | 2/1967 | Pinkowski | 407/47 |
| 4,826,090 | 5/1989 | Orphall | 241/294 |
| 4,932,813 | 6/1990 | Qvart | 407/46 |

FOREIGN PATENT DOCUMENTS

| | | |
|---|---|---|
| 0298940 A2 | 1/1989 | European Pat. Off. . |
| 6933019 | 12/1969 | Germany . |

*Primary Examiner*—W. Donald Bray
*Attorney, Agent, or Firm*—Blank Rome Comisky & McCauley LLP.

[57] ABSTRACT

In a profiled inserted-blade cutter, with blades (13) which can be re-sharpened without altering the profile and trajectory, each blade (13) is secured to a blade holder (14) having a base with a T-shape cross section, one arm (16) of the transverse section of which engages in a first longitudinal groove (4) in the basic unit (2). The other arm (17) engages in a second longitudinal groove (5) also in the basic unit (2) and open towards the first groove (4). The flanks of the first and second longitudinal grooves (4, 5) at a greater distance from the central longitudinal axis of the basic unit (2) lie in planes which are mutually parallel and parallel to the longitudinal axis of the basic unit and each form a positioning surface (6, 7) for one or other arm (16, 17) of the transverse section. On the blade holder (14) there is a clamping surface (15) which encloses a radially outwardly opening angle with the frontal surface (13') of the blade (13) and an acute angle with the adjacent positioning surface (7). The clamping force of each clamping screw (21) is directed against the clamping surface (15) and presses the blade holder (14) with a first component against the frontal stop surface (9) and with a second component against the two positioning surfaces (6, 7).

19 Claims, 6 Drawing Sheets

PROFILED INSERTED-BLADE CUTTER

BACKGROUND OF THE INVENTION

The invention relates to a profiled cutter head having cutters which can be resharpened without changing the profile and trajectory, which cutter head has the features of the preamble of claim 1.

BRIEF DESCRIPTION OF THE INVENTION

In a known profiled cutter head of this kind (G 69 33 019), each cutter support is clamped by means of screws against the base of the recess accommodating it in the basic body. Radially inside the cutter fixed to the cutter support, the cutter support has a bead-like protrusion which engages deeper into a groove in the basic body the smaller the thickness of the cutter becomes owing to its being ground away on its front for the purpose of resharpening. As soon as the engagement in the groove is free from play, this positive lock allows at least some of the centrifugal forces acting on the cutter to be taken up and thus makes it possible to prevent an increase in the trajectory owing to centrifugal force. However, fitting of this kind is complicated in terms of production engineering. Moreover, the screws have to be tightened carefully.

OBJECT OF THE INVENTION

The object underlying the invention is to provide a profiled cutter head having cutters which can be resharpened without changing the profile and trajectory, which cutter head has advantages over the known profiled cutter heads of the type discussed and in particular can be realized without expensive construction means. This object is achieved by a profiled cutter head having the features of claim 1.

A profiled cutter head of this kind does not require any special fitting. The cutter support and the cutter fixed thereto are positioned without fitting measures exclusively by means of the flanks, which form the bearing surfaces for the transverse part of the foot of the cutter support, of the grooves provided in the basic body and by means of the frontal stop surface. A positive lock which is free from play is then present in the direction in which the centrifugal force and the cutting force act. A further significant advantage consists in the fact that the force of the setscrew or setscrews, like the centrifugal force, presses the cutter support with its cutter against the surfaces serving for positioning, for which reason the centrifugal force is unable to bring about any change in position. The cutter head is therefore able to withstand high dynamic loads. This contributes to cost-effective production. Resharpening is carried out on the front of the cutter and can therefore be performed in a simple manner. Furthermore, the tool according to the invention makes it possible to achieve high cutting rates, long total tool paths and an excellent cutting quality. The cutter material can be utilized virtually completely, so that there is no need to throw away valuable cutting material. Furthermore, the basic body can be reused. The same cutter supports can be used for various profiles. Due to the exchangeability of the cutter supports, a modular system is obtained. Tool geometries and cutting materials which are adapted to the material can therefore be used without problems. The chip space can be configured optimally, as a result of which the dust fraction produced during the machining of wood can be significantly reduced.

Due to the fact that precise positioning of the cutter is inevitably achieved during clamping of the cutter support, a tool change is easy to carry out. The play-free positioning of the cutter ensures a high degree of accuracy during repeat positioning. The basic body may optionally consist of steel or aluminium, aluminium leading to a lower residual imbalance and thus protecting the bearings of the mounting spindle of the machine. The fact that it is possible to select large axis angles for a low power consumption and that the rake angle can be adapted to the material contributes further to a low machine loading.

The play-free positive lock of the cutters results in a high level of safety for the user and a high level of operational reliability. The feed can take place mechanically or manually. Furthermore, the tool according to the invention is maintenance-friendly. Simple and error-free resharpening can take place in a sharpening device. The tool is easy to clean, owing to a closed design. Large setscrews which are easy to undo prevent overtightening.

The solution according to the invention can be applied not only to cutter heads with disk- or bowl-like basic bodies but also to cutter heads with an offset, i.e. bell-like, basic body, the receptacles of which are open towards the ring-disk-like end face.

The cutter head according to the invention can be used for profiling and joining, specifically both as a single tool and as a set of tools comprising a plurality of individual tools. The cutters are preferably super-high-speed steel- Stellite- or carbide-tipped cutters on the frontal stop surface 9.

DETAILED DESCRIPTION OF THE PREFERRED EMBODIMENTS

Figure 1:
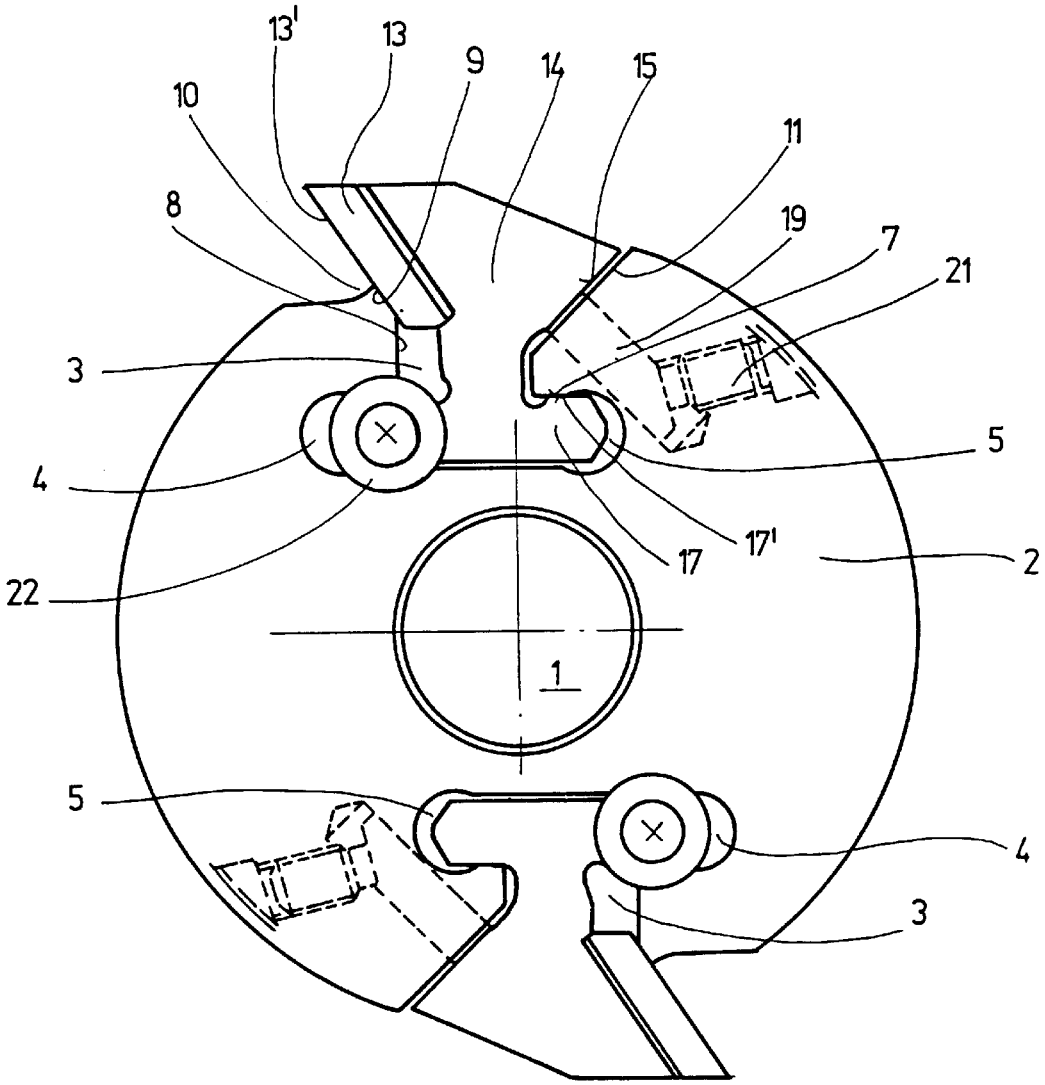

In a preferred embodiment, that region of the receptacle which accommodates the foot has a T-shaped cross-sectional profile, the transverse part of which is formed by the two longitudinal grooves, the flanks of which, serving to support the foot of the cutter support, preferably then lie in one and the same plane. The extent to which the two arms of the foot can be displaced in the longitudinal grooves in the direction of their depth and to which the longitudinal part of the foot can be displaced in the longitudinal part of that region of the receptacle which accommodates the foot is selected here to be at least equal to the thickness of the layer of the cutter which can be ground off during resharpening. The cutter material can therefore be virtually completely consumed during resharpening. The reduction in the cutter thickness owing to resharpening has no effect on the positioning of the cutter and its support and on the play-free positive lock between the cutter support and the basic body. The maximum permissible removal of material from the front of the cutter during resharpening can be determined in a simple manner by allowing the longitudinal part of the foot to come to bear against the limit surface, which adjoins the frontal stop surface, of the longitudinal part of the receptacle when the cutter has reached its minimum thickness. As long as there continues to be a gap between these two surfaces, the cutter can be resharpened.

The positioning surfaces formed by the flanks of the groove preferably run at a right angle to a radial plane. Furthermore, the angle which the frontal stop surface and the neighbouring positioning surface include, like the angle which the clamping surface of the cutter support and the neighbouring positioning surface include, is preferably less than 80°.

Preferably, it is not the setscrew which bears against the clamping surface of the cutter support, but rather the end face of a pressure pin which is guided in a bore, which runs perpendicular to the clamping surface, in the basic body. If it is not possible, in particular for reasons of space, for the pressure screw to be arranged coaxially with the pressure pin, that end of the pressure pin which is remote from the clamping surface is bevelled. The longitudinal axis of the clamping screw then runs perpendicular to this inclined surface, the wedge angle of the inclined surface with respect to the longitudinal axis of the pressure pin preferably being selected to be greater than 30°.

The profiled cutter head according to the invention is suitable not only for embodiments in which the axis angle is zero, i.e. the longitudinal axis of each recess runs parallel to the central longitudinal axis of the basic body, but rather it is possible to provide axis angles different from zero, it being possible to retain the cross-sectional profile of the receptacles and the cutter supports, i.e. there is no need to make a major change either to the receptacles in the basic body or to the cutter support.

In a preferred embodiment, an axial stop which protrudes beyond the cross-sectional profile of the cutter support is fixed to the foot thereof for positioning in the axial direction.

If the profiled cutter head according to the invention is designed not as a tool with a central receiving bore but rather as a shank tool, it is preferred for one end face of the basic body to bear against an end face of the shank, concentrically thereto. This end face of the shank is advantageously provided on a flange-like end which has a greater diameter than the remaining part of the shank. Furthermore, it is advantageous if, in the case of such a shank tool, the basic body has a centring peg which projects beyond the end face bearing against the shank, which centring peg engages without play in a centring bore in the shank. Axially parallel through bores, which are aligned with threaded bores of the flange-like end section of the shank and accommodate connecting screws, may be provided in the basic body for connecting the basic body to the shank.

Figure 2:
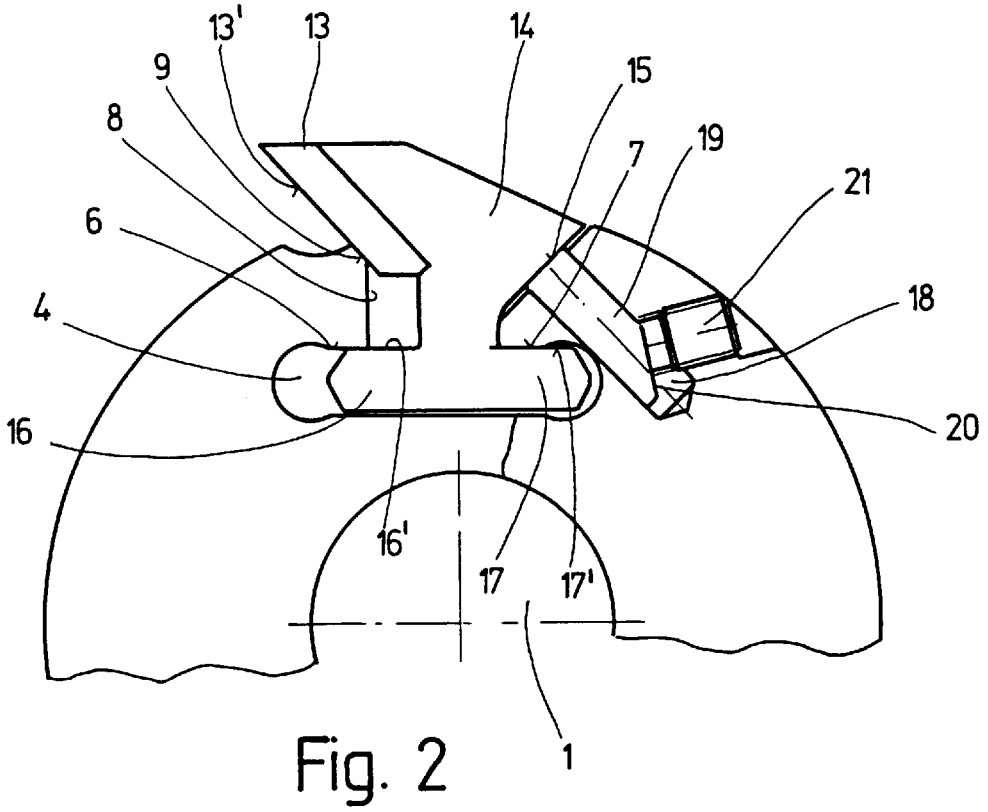
Figure 3:
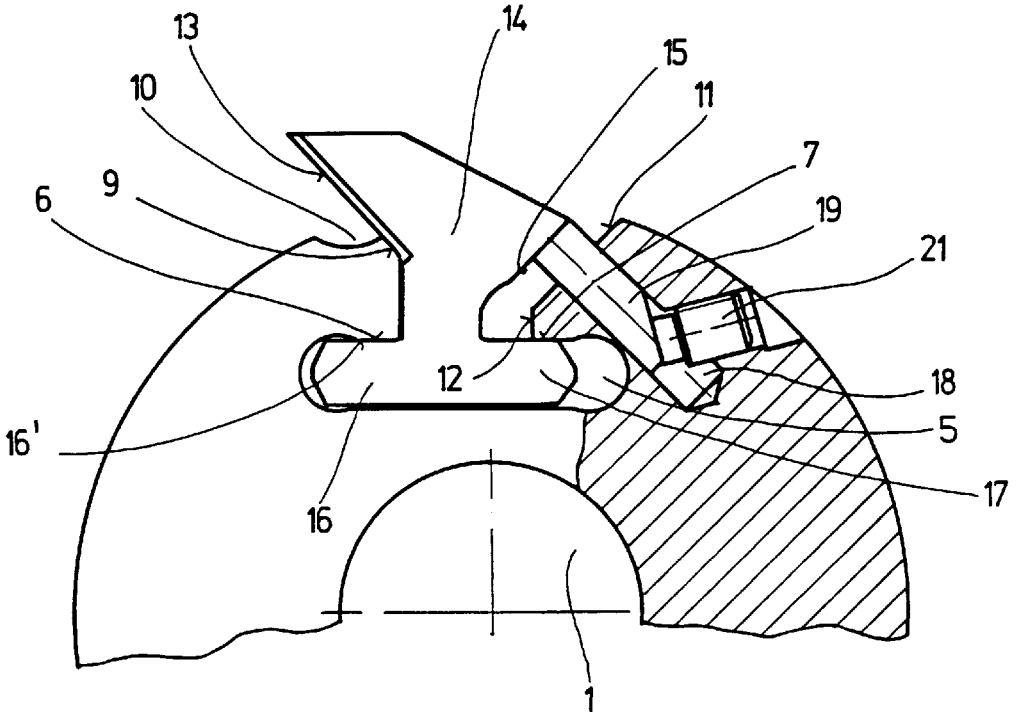
Figure 4:
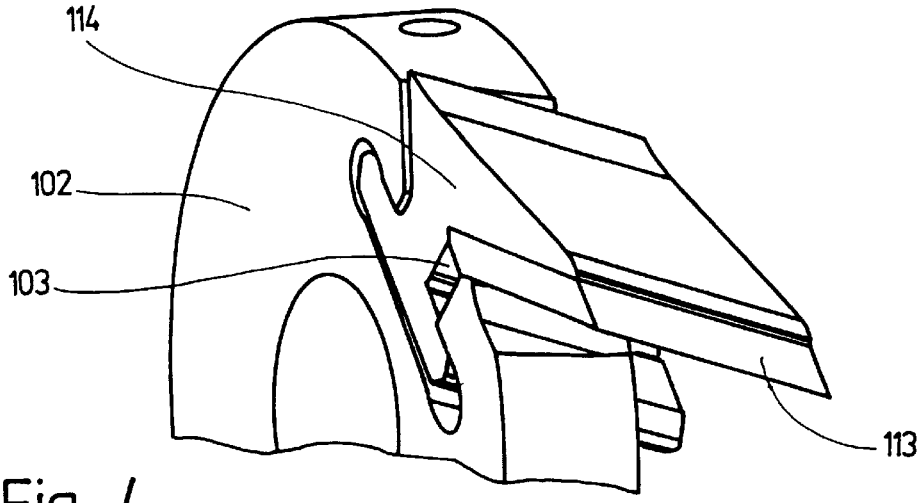
Figure 5:
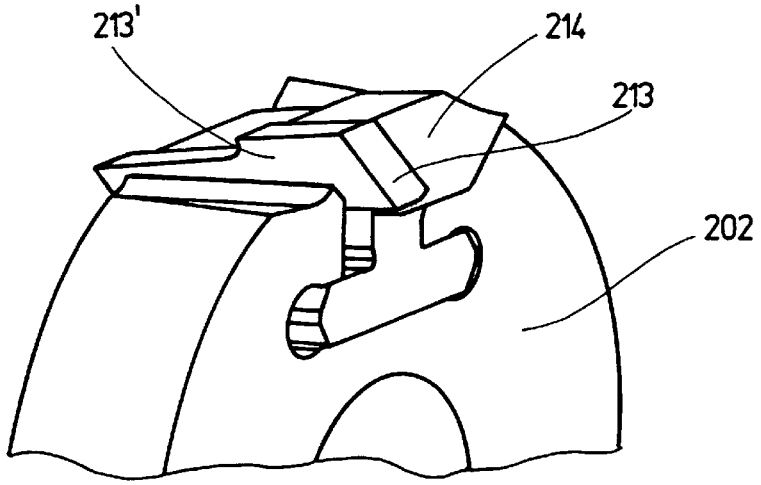
Figure 6:
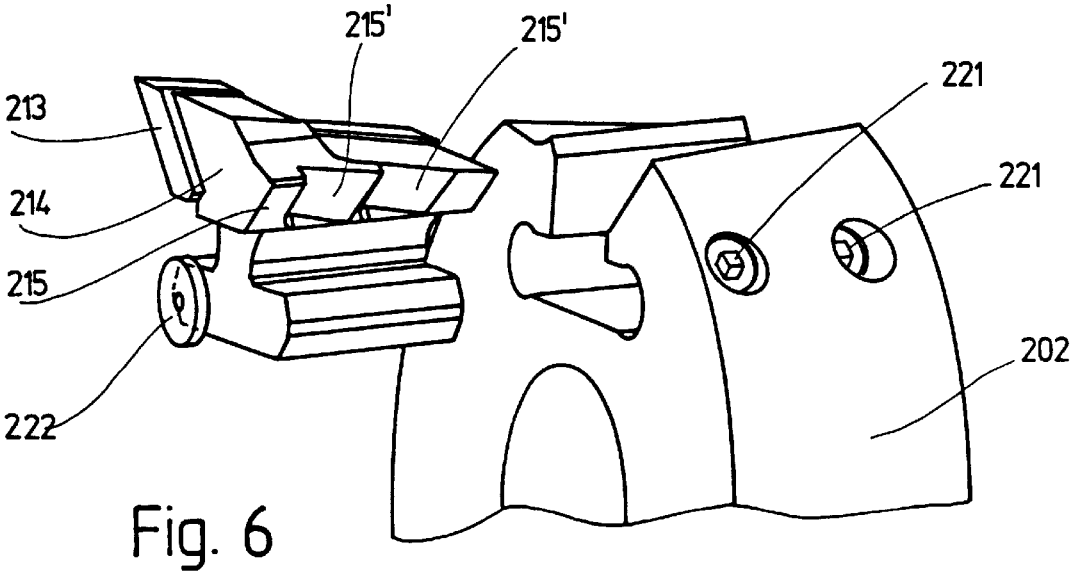
Figure 7:
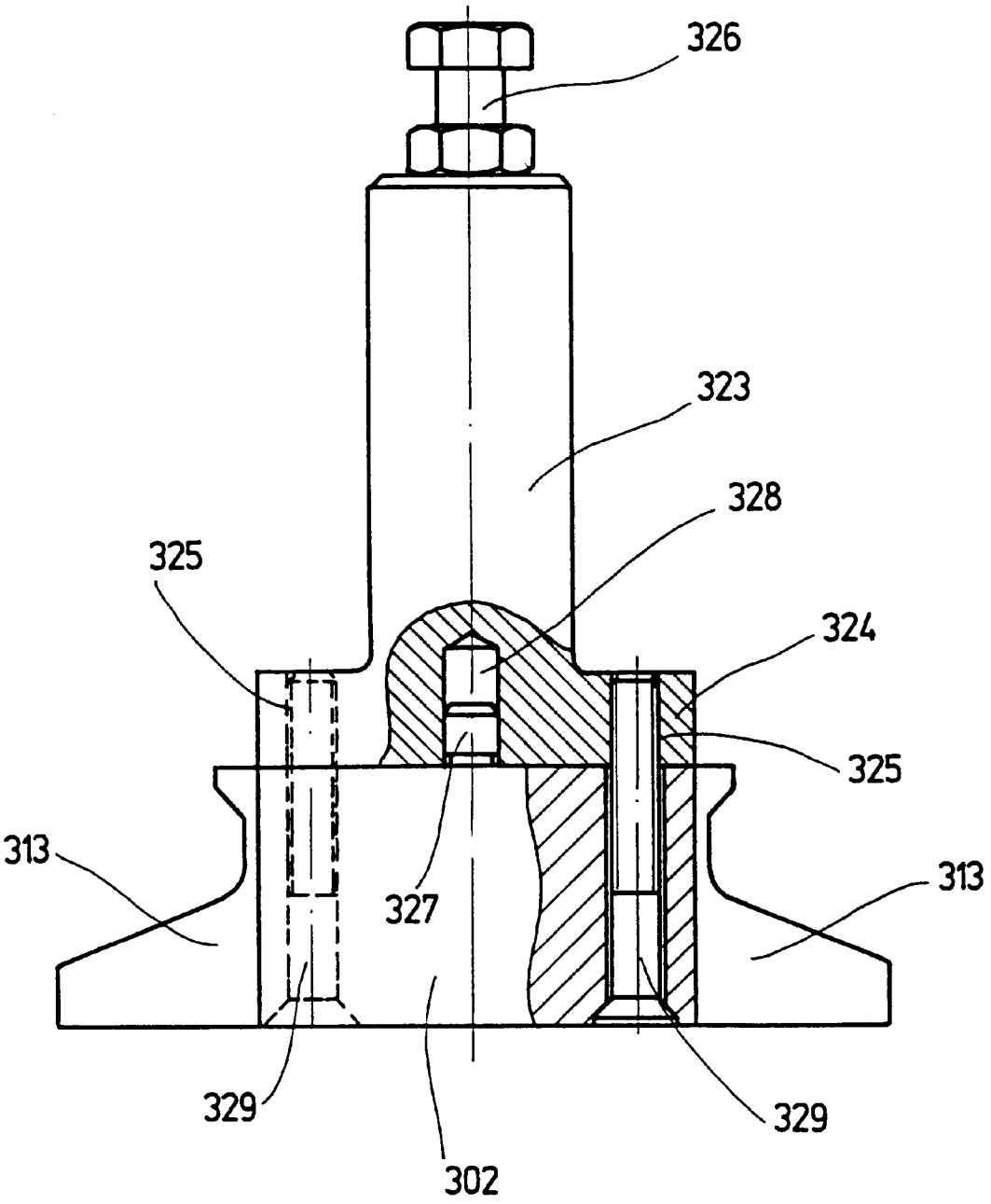
Figure 8:
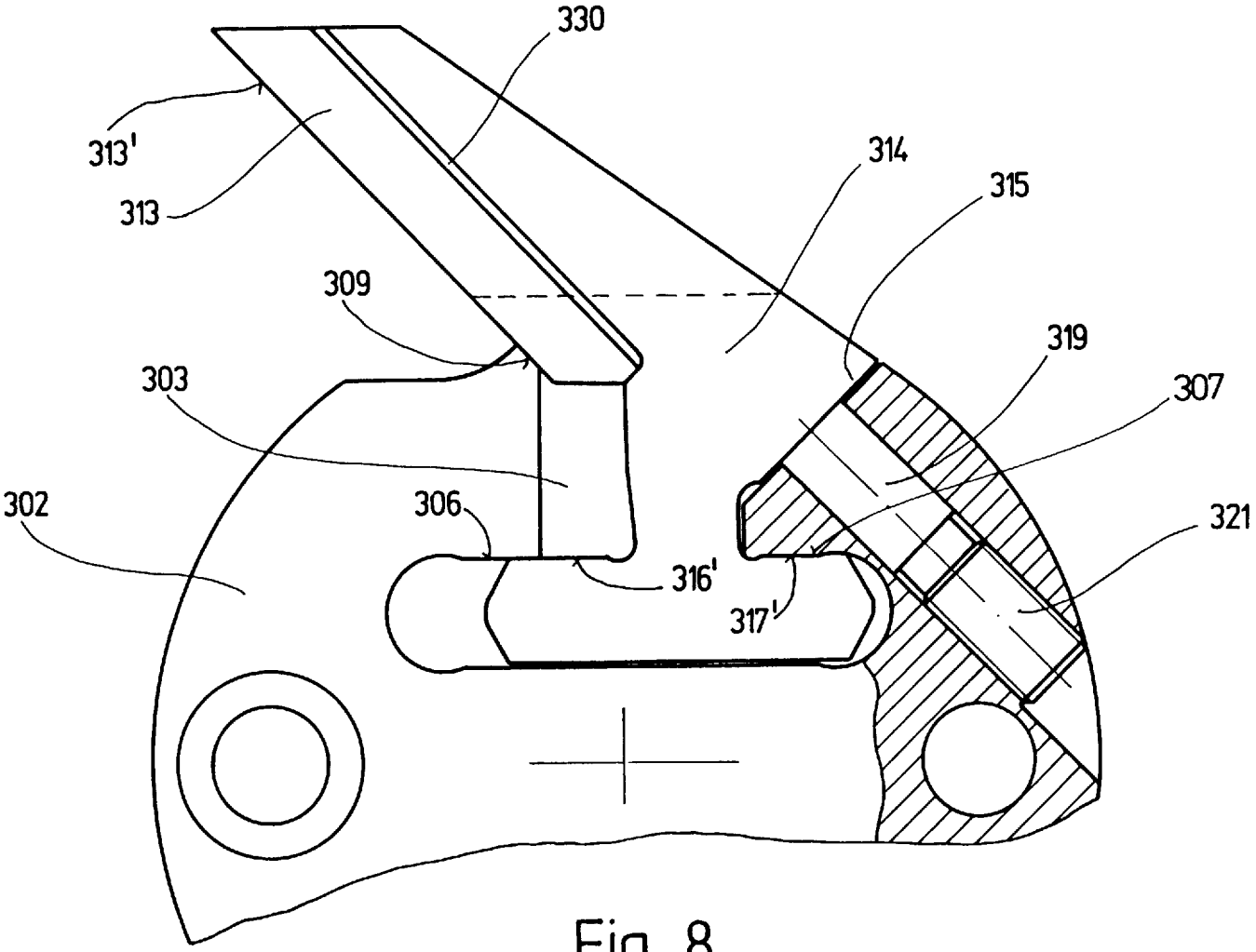
Figure 9:
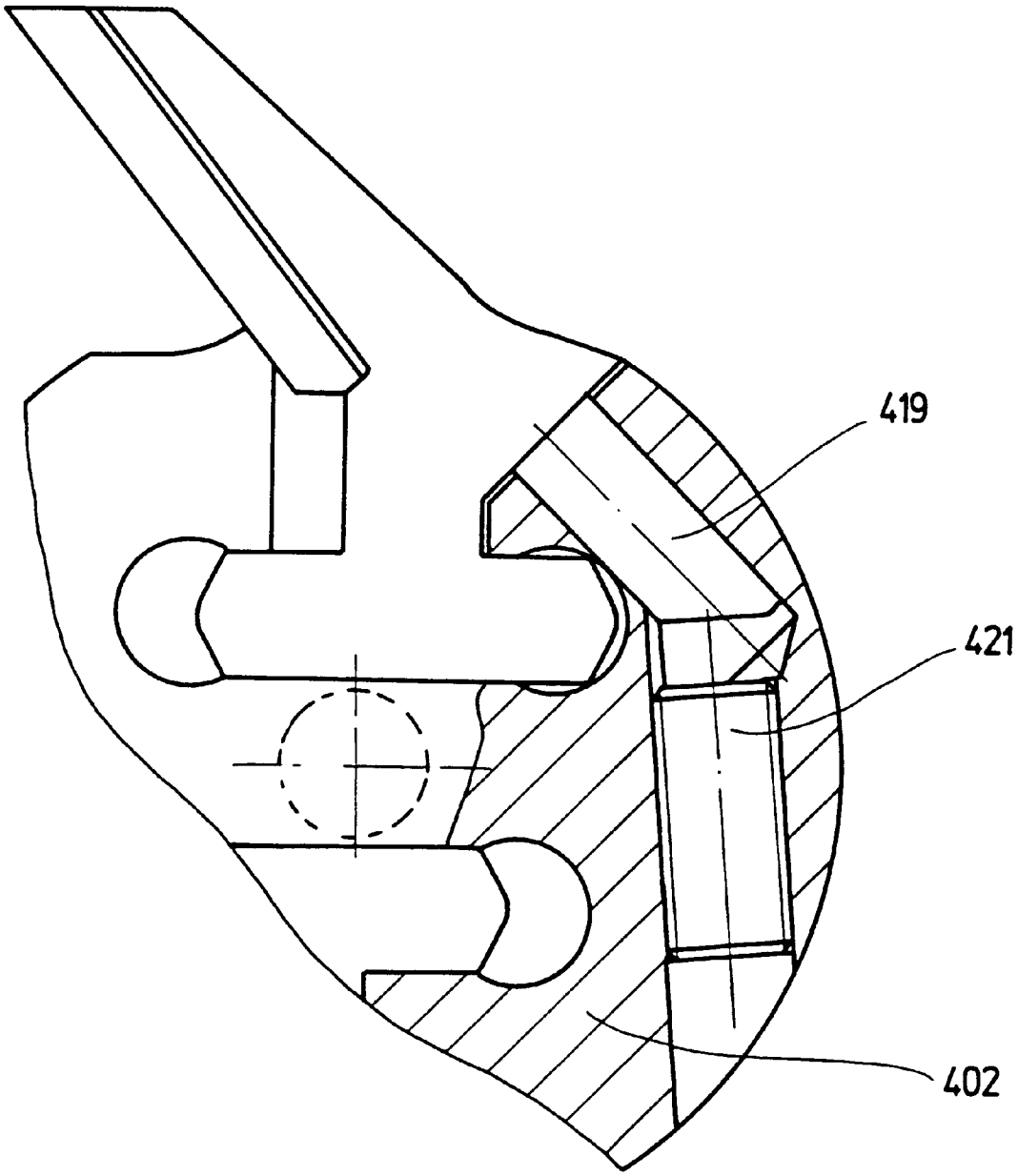

The invention is explained in detail below with reference to exemplary embodiments depicted in the drawing, in which:

FIG. 1 shows an end view of a first exemplary embodiment,

FIG. 2 shows an end view, illustrated incompletely and partially in cross-section, of the first exemplary embodiment with the tool in the as-new condition, FIG. 3 shows an end view, illustrated incompletely and partially in cross-section, of the first exemplary embodiment at the end of the resharpening path, FIG. 4 shows a view, illustrated diagrammatically and in perspective and also incompletely, of a second exemplary embodiment with an axis angle different from zero and a rectilinear cutting blade, FIG. 5 shows a view, illustrated diagrammatically and in perspective and also incompletely, of a third exemplary embodiment with an axis angle different from zero and a profiled cutter, FIG. 6 shows another view, illustrated in perspective, of the exemplary embodiment in accordance with FIG. 5 with the cutter removed from the basic body in the axial direction, FIG. 7 shows a side view, illustrated incompletely and partially in section, of a fourth exemplary embodiment in the form of a shank tool, FIG. 8 shows an incomplete end view, illustrated partially in section and on an enlarged scale, of the exemplary embodiment in accordance with FIG. 7, FIG. 9 shows an end view, illustrated incompletely and partially in section, of a modification to the exemplary embodiment in accordance with FIGS. 7 and 8.

The exemplary embodiment depicted in FIGS. 1 to 3 of the profiled cutter head according to the invention has a basic body 2, which is provided with a central bore 1 for receiving a shaft, is made of steel or aluminium and in which two receptacles 3 are made, which receptacles are of identical design and are arranged diametrically with respect to the central bore 1. Since the axis angle in this cutter head is zero, the receptacles 3 run parallel to the longitudinal axis of the basic body 2. Its cross-sectional profile is composed of a trapezoidal region which widens towards the outer circumferential surface and a T-shaped region, the longitudinal part of which extends radially inwards from the trapezoidal region towards the transverse part formed by two longitudinal grooves 4 and 5. The two longitudinal grooves 4 and 5, which are open towards one another, are bounded radially to the outside by a first positioning surface 6 and a second positioning surface 7, respectively, both of which lie in the same plane which, together with a radial plane, includes an angle of 90°. The first positioning surface is adjoined at right angles by a limiting surface 8 which is adjoined by a frontal stop surface 9, which is inclined with respect to a radial plane by the rake angle. In the exemplary embodiment, one edge of a chip removal groove 10 made in the basic body 2 adjoins the frontal stop surface 9.

Together with the frontal stop surface 9, a likewise planar side surface 11 of the receptacle 3 includes an angle of slightly less than 90° and is adjoined by a limiting surface 12, which runs parallel to the limiting surface 8 and on the other side adjoins the second positioning surface 7. As shown in particular by FIGS. 2 and 3, the radial extent of the limiting surface 12 is significantly less than that of the limiting surface 8, due to the fact that the side surface 11 is significantly wider than the frontal stop surface 9.

A cutter support 14, which is equipped with a resharpenable cutter 13 and the axial length of which may be greater than that of the basic body 2, is inserted into each of the receptacles 3. The two identically formed cutter supports 14, which are preferably cut to length from a correspondingly profiled bar, have a head part, against whose surface which is situated at the front in the running direction the cutter 13, which is soldered onto the cutter support 14, bears. The surface which delimits the cutter support 14 on the outside is profiled in the same way as the cutter 13. Since in the exemplary embodiment in accordance with FIGS. 1 to 3 the cutting edge is rectilinear, this surface lies in the plane defined by the flank of the cutter 13. Towards the side surface 11, the head region of the cutter support 14 is delimited by a planar clamping surface 15 running parallel to the side surface 11.

The head region of the cutter support 14 is adjoined radially on the inside by a T-shaped foot region, the transverse part of which forms a first arm 16 engaging in the longitudinal groove 4 and a second arm 17 engaging in the longitudinal groove 5. As shown by FIGS. 2 and 3, the thickness of the arms 16 and 17 is less than the width of the longitudinal grooves 4 and 5. The first arm 16 is delimited radially on the outside by a stop surface 16' and the second arm 17 is delimited radially on the outside by a stop surface 17'. The stop surface 16' is intended to bear against the first positioning surface 6, and the stop surface 17' to bear against the second positioning surface 7. Like the positioning surfaces 6 and 7, the two stop surfaces 16' and 17' lie in one and the same plane.

As also shown by FIGS. 2 and 3, the distance between the limiting surface 8 and the limiting surface 12 of the basic body 2 is larger by slightly more than the resharpening path than the thickness, measured in this direction, of the longitudinal part of the foot of the cutter support 14. In the as-new state of the cutter 13, the longitudinal part of the foot is at only a small distance from the limiting surface 12 of the receptacle 3. As the thickness of the cutter 13 decreases owing to the resharpening, the central part of the foot comes ever closer to the limiting surface 8 until at the minimum thickness of the cutter it is only a distance of about 0.2 mm from the limiting surface 8. This thin gap indicates that the cutter 13 can no longer be sharpened further. As the thickness of the cutter decreases, the first arm 16 penetrates ever further into the longitudinal groove 4 during positioning of the cutter support 14, while the second arm 17 is moved further and further out of the longitudinal groove 5. However, the two arms 16 and 17, both with the maximum and minimum thickness of the cutter, still engage sufficiently deep into the longitudinal grooves 4 and 5, respectively, to position the cutter 13 by bearing against the positioning surfaces 6 and 7, respectively, and, for the forces acting on the said cutter and on the cutter support 14, to join to the basic body 2 in a positively-locking manner.

Starting from the side surface 11, a number of blind bores 18 penetrate into the basic body 2, perpendicular to the side surface 11, which number is dependent on the axial length of the basic body 2 and of the cutter support 14; if a plurality of these blind bores 18 are provided, their longitudinal axis lies in a plane parallel to the longitudinal axis of the basic body 2. A pressure pin 19, one end face of which bears against the clamping surface 15 of the cutter support 14, is arranged longitudinally displaceably in each blind bore 18. The end remote from this end forms an inclined surface 20 which, together with the longitudinal axis of the pressure pin 19, includes an angle of more than 30°. This inclined surface 20 is adjoined by the end face of a setscrew 21, which is situated in a threaded bore, running perpendicular to the inclined surface 20, of the basic body 2. The inclined surface 20 converts the screw force acting in the longitudinal direction of the setscrew 21 into a clamping force acting in the longitudinal direction of the pressure pin 19.

As shown in FIG. 1, in order to position the cutter support 14 and the cutter 13 in the axial direction, a disk-like axial stop 22 is fixed, specifically by means of a screw in the exemplary embodiment, to one end face of the cutter support 14 in the region of the free end of the first arm 16. When the cutter support 14 is correctly positioned, this axial stop 22 bears against the end face of the basic body 2 in the region of the longitudinal groove 4.

When the cutter support 14 has reached its correct axial position and the setscrew or setscrews 21 are tightened, the cutter support 14 is initially pushed to the left, when viewed in accordance with FIGS. 1 to 3, until the front surface 13' of the cutter 13 bears against the frontal stop surface 9 of the basic body 2. The force of the setscrews 21 then has the effect of pressing the stop surfaces 16' and 17' of the arms 16 and 17, respectively, onto the positioning surfaces 6 and 7, respectively. The cutter support 14 and the cutter 13 are now positioned, without additional fittings, precisely, due to the fact that there is no play, and moreover in a positively-locking manner with respect to the clamping force and the centrifugal force. The cutter support 14 and the cutter 13 are also connected in a positively-locking manner to the basic body 2 with regard to the cutting force. The tool can therefore be subjected to high dynamic loads.

To resharpen the cutter 13, the setscrews 21 merely have to be loosened slightly. The cutter support 14 can then be removed from the receptacle 3 in the axial direction. After resharpening, which does not lead to any change in the profile, because the resharpening takes place on the front surface 13' of the cutter 13, precisely the same trajectory is achieved again, because the cutter support 14 is displaced towards the frontal stop surface 9, with respect to the previous positioning, only by the resharpening distance and, moreover, the positioning and positively-locking connection to the basic body 2 are unchanged.

The exemplary embodiment in accordance with FIG. 4 differs from that in accordance with FIGS. 1 to 3 only in that it has an axis angle which is different from zero. The limiting surfaces of the recesses 103 of the basic body 102 are merely rotated through the axis angle in the plane of the flank. The cross-sectional profile of both the recess 103 and of the cutter support 114 are therefore unchanged by comparison with the exemplary embodiment in accordance with FIGS. 1 to 3. Reference can therefore be made to the first exemplary embodiment with regard to the further design of the basic body 102, the cutter support 114 and the cutter 113.

The cutter support 114 can be cut from the same section bar as the cutter support 14. It is merely necessary here for the plane of the cut to be offset by the axis angle with respect to a cross-sectional plane. FIG. 4 also shows that the cutter support 114, together with the cutter 113, can project beyond one end face of the basic body 102.

The exemplary embodiment depicted in FIG. 5 differs from that in accordance with FIG. 4 essentially only in that each cutter 213 and, in the same way, the head part of each cutter support 214, is profiled. This profile too does not change as a result of resharpening of the cutter 213 on its front surface 213'. The trajectory too does not change as a result of the resharpening. As shown by FIG. 6, the axis angle which is different from zero makes it necessary to provide a pocket in the clamping surface 215 of the cutter support 214 for each pressure pin, which pocket forms a stop surface 215', lying parallel to the end face of the pressure pin, for the end face of the pressure pin. The two setscrews, which are each arranged in a threaded bore of the basic body 202, are denoted by 221, while the axial stop of the cutter support 214 is denoted by 222. Reference is made to the exemplary embodiment in accordance with FIGS. 1 to 3 with regard to the remaining details, since in this respect the third exemplary embodiment is identical to the first exemplary embodiment.

In contrast to the exemplary embodiments in accordance with FIGS. 1 to 6, which involve tools with a bore, FIGS. 7 and 8 show a shank tool.

A cylindrical shank 323 has at its end a cylindrical flange 324 and at its other end a central threaded bore, into which a screw 326 can be screwed. One end face of a basic body 302 of a profiled cutter head bears against the free end face of the flange 324. For centring purposes, a central centring peg 327 protrudes beyond this end face of the basic body 302 and engages without play in a central centring bore 328 of the flange 324. Two through bores, which lie diametrically with respect to the longitudinal axis of the tool, of the basic body 302 are in each case aligned with a threaded bore 325 of the flange 324. Screws 329 clamp the basic body 302 against the flange 324 without play.

The basic body 302 is provided with two diametrically arranged, identically designed receptacles 303, which, as FIG. 8 shows, have the same shape as the receptacles 3 of the first exemplary embodiment. The associated cutter supports 314 also have essentially the same shape as the cutter support 14. In particular, the play-free connection, which is positively locking for the clamping force and the centrifugal force and the cutting force, between the cutter support 314 and the basic body 303 is carried out, as in the exemplary embodiments described above, by means of the two positioning surfaces 306 and 307, the frontal stop surface 309 and the clamping surface 315. The cutter 313 soldered onto the cutter support 314 is a tip made of sintered carbide, Stellite or super-high-speed steel. The layer of solder is noted by 330.

As shown in FIG. 8, the spatial conditions allow the setscrews 321 in the basic body 302 to be arranged coaxially with the associated pressure pins 319.

When the setscrews 321 are tightened, the clamping force, which is transmitted via the pressure pin 319 to the cutter support 314 and runs approximately parallel to the frontal surface 313' of the cutter 313, has the effect of bringing the cutter 313 to bear against the frontal stop surface 309 and then of pressing the stop surfaces 316' and 317' against the two positioning surfaces 306 and 307.

Instead of arranging the pressure pin and the setscrew to form an angle which opens towards the circumferential surface of the basic body, as is the case in the exemplary embodiment s in accordance with FIGS. 1 to 6, or instead of a coaxial arrangement as in the exemplary embodiment in accordance with FIGS. 7 and 8, it is possible, if spatial conditions in the basic body 402 allow, also to arrange the pressure pin 419 and the setscrew 421 such that they form an angle which opens towards the centre of the basic body 402, as shown by FIG. 9.

What is claimed:

1. Profiled cutter head comprising:

a basic body having first and second end faces, a recess and a central longitudinal axis, the recess providing a frontal stop surface, the recess comprising a longitudinal groove which has a first end portion and a second end portion;

a blade holder having a base, the base being disposed in the recess and pointing toward the central longitudinal axis;

clamping means for clamping the base of the blade holder in position in the recess; and a cutter which has a front surface and can be resharpened without changing a profile and trajectory of the cutter, the cutter resting with its front surface against the frontal stop surface and being fixed to the blade holder; wherein:

(a) the foot has a T-shaped cross-section to define a transverse part with a first arm and a second arm, the transverse part engaging by means of the first arm into the first end portion of the longitudinal groove;

(b) the second arm of the transverse part of the foot engages in the second end portion of the longitudinal groove;

(c) the first and second end portions of the longitudinal groove include flanks which are on a far side of the longitudinal groove from the central longitudinal axis of the basic body and which lie in planes which are parallel to each other and to the longitudinal axis of the basic body and which are at an acute angle to the frontal stop surface, each of the flanks including a positioning surface for a respective one of the first and second arms of the transverse part;

(d) the blade holder has a clamping surface which defines with the front surface of the cutter a radially outwardly opening angle and which defines with an adjacent one of the positioning surfaces an acute angle; and (e) the clamping means comprises means for directing a clamping force toward the clamping surface of the blade holder to press the blade holder against the frontal stop surface and to press the first and second arms against the positioning surfaces.

2. The cutter head according to claim 1, wherein the clamping means comprises a plurality of locking set screws directed towards the clamping surface.

3. The cutter head according to claim 1, wherein the longitudinal groove and the first and second arms are dimensioned such that an extent to which the first and second arms of the foot can be displaced in the first and second end portions of the longitudinal groove in a direction of their depth and an extent to which a longitudinal part of the foot can be displaced in a longitudinal part of recess is selected to be at least equal to a thickness of a layer of the cutter which can be ground off during resharpening.

4. The cutter head according to claim 3, wherein the recess has a limiting surface adjacent to the frontal stop surface, and wherein the longitudinal part of the foot bears against the limiting surface when the cutter has reached a minimum thickness and bears against the frontal stop surface.

5. The cutter head according to claim 1, wherein the two positioning surfaces lie in one and the same plane.

6. The cutter head according to claim 6, wherein a width of the two end portions of the longitudinal groove is greater than a thickness, measured in a same direction, of the first and second arms.

7. The cutter head according to claim 2, wherein the clamping means further comprises a pressure pin which has an end face for bearing against the clamping surface is arranged in a bore, extending perpendicular to the clamping surface.

8. The cutter head according to claim 7, wherein the pressure pin has a second end face which is remote from the clamping surface and which bears against a front end of one of the plurality of set screws.

9. The cutter head according to claim 8, wherein the second end face of the pressure pin is bevelled to have an inclined surface, and wherein the one of the plurality of set screws against which the pressure pin bears has a longitudinal axis that extends perpendicular to the inclined surface.

10. The cutter head according to claim 9, wherein the pressure pin has a longitudinal axis and wherein a wedge angle of the inclined surface with respect to the longitudinal axis of the pressure pin is greater than 30°.

11. The cutter head according to claim 1, wherein the blade holder further comprises an axial stop which projects beyond a cross-sectional profile of the blade holder and is fixed to the foot.

12. The cutter head according to claim 1, designed as a shank tool and further comprising means for attaching the basic body to a shank.

13. The cutter head according to claim 12, wherein one end face of the basic body bears against an end face of the shank concentrically with respect to the letter.

14. The cutter head according to claim 13, wherein the end face of the shank is provided on a flange-like end section.

15. The cutter head according to claim 11, wherein the basic body has a centering peg which protrudes beyond and end face bearing on the shank and engages without play in a central bore in the shank.

16. The cutter head according to claim 12, further including axially parallel through-bores in the basic body and threaded bores, which are aligned with said through-bores, of the flange-like section of the shank of the connecting screws.

17. The cutter head according to claim 1, wherein the clamping means comprises a clamping screw.

18. The cutter head according to claim 1, wherein the longitudinal groove extends from the first end face to the second end face.

19. The cutter head according to claim 1, wherein the planes in which the positioning surfaces lie are at an angle of 90° to a radial plane of the basic body.

* * * * *